United States Patent [19]

Conrad

[11] Patent Number: 4,624,205

[45] **Date of Patent: * Nov. 25, 1986**

[54] METHOD OF STRESS DISTRIBUTION IN A SAIL, A SAIL EMBODYING THE SAME AND SAIL CONSTRUCTION

[75] Inventor: Peter G. Conrad, Old Lyme, Conn.

[73] Assignee: Sobstad Sailmakers, Inc., Old Saybrook, Conn.

[ * ] Notice: The portion of the term of this patent subsequent to Jun. 10, 2003 has been disclaimed.

[21] Appl. No.: 722,268

[22] Filed: Apr. 11, 1985

Related U.S. Application Data

[63] Continuation-in-part of Ser. No. 681,933, Dec. 14, 1984, Pat. No. 4,593,639.

[51] Int. Cl.[4] ..... B63H 9/06

[52] U.S. Cl. ..... 114/103

[58] Field of Search ..... 114/39, 102, 103, 109

[56] References Cited

U.S. PATENT DOCUMENTS

| | | | |
|---|---|---|---|
| 3,756 | 9/1844 | Trail | 114/103 |
| 4,305 | 12/1845 | Maull | 114/103 |
| 30,694 | 11/1860 | Sands . | |
| 401,373 | 4/1889 | Roberts . | |
| 1,411,504 | 4/1922 | Monro | 114/103 |
| 2,378,877 | 6/1945 | Waller . | |
| 2,589,203 | 10/1949 | Nilsen . | |
| 3,174,453 | 3/1965 | Lemoigne | 114/103 |
| 3,602,180 | 8/1971 | Holmes . | |
| 3,611,649 | 10/1971 | Muller et al. . | |
| 3,626,886 | 2/1971 | Cafiero . | |
| 3,828,711 | 8/1974 | Russell | 114/103 |
| 3,903,826 | 9/1975 | Andersen . | |
| 3,954,076 | 5/1976 | Fracker | 114/103 |
| 4,041,653 | 8/1977 | Rain . | |
| 4,263,861 | 4/1981 | Vicard | 114/103 |
| 4,383,492 | 5/1983 | Harris et al. . | |
| 4,444,822 | 4/1984 | Doyle | 428/109 |
| 4,449,467 | 5/1984 | Hild et al. . | |
| 4,476,799 | 10/1984 | Bandy . | |

FOREIGN PATENT DOCUMENTS

| | | |
|---|---|---|
| 702469 | 1/1941 | Fed. Rep. of Germany . |
| 909899 | 3/1954 | Fed. Rep. of Germany . |
| 967484 | 11/1950 | France . |
| 563913 | 6/1957 | Italy . |
| 58-112895 | 7/1983 | Japan . |
| 1196756 | 7/1970 | United Kingdom . |
| 1314579 | 4/1973 | United Kingdom . |

*Primary Examiner*—Trygve M. Blix.
*Assistant Examiner*—Stephen P. Avila
*Attorney, Agent, or Firm*—Fred A. Keire

[57] ABSTRACT

A sail and a method for constructing a sail or any pliable lifting surface where the lift for or the motive power therefor is wind.

30 Claims, 2 Drawing Figures

71
71a
PANEL #5

90
34
10
24
37
PANEL #4
24
91
9
34
26
16
34
90
19
34
81
PANEL #3
91
31
5
34
31
26
34
78
77
34
90
24
PANEL #2
34
34
91
78'
77'
26
79
79
90
34
41
91
74'
PANEL #1
75'
41
22
22
12
76
17
24
76
14

METHOD OF STRESS DISTRIBUTION IN A SAIL, A SAIL EMBODYING THE SAME AND SAIL CONSTRUCTION

This application is a continuation-in-part of my application Ser. No. 06/681,933 filed Dec. 14, 1984 now U.S. Pat. No. 4,593,639.

This invention relates to a novel construction of a pliable lifting surface. More particularly, this invention relates to a novel lifting surface such as a sail, a method for construction of it, and a method for stress distribution in the sail whereby greatly improved weight savings, weight distribution, and considerable savings in material costs are achieved.

In my previous application I described a method for constructing a sail or any pliable lifting surface where the lift for or the motive power therefor is wind. More particularly, I described my invention as relating to a pliable lifting surface such as a sail which is used as a motive power for devices using air motion as the motive power; in particular, a sail as an article of manufacture.

The disclosure in my previous application is now incorporated by reference herein.

BACKGROUND FOR THE INVENTION

As previously disclosed, because of the distortions and especially irreversible distortions when a sail has been overstressed, the restrictions on the wind speed are especially severe when the laminated sails are bieng used. Laminated sails distort precipitously beyond a yield point and the sail then loses its efficient lifting surface characteristics or is totally destroyed.

As consequence, modern backing fabrics have been employed to stabilize the laminate film, and the modern laminates consist predominantly of Mylar film with Dacron reinforcements and Mylar film with Kevlar reinforcements. Mylar is a film and Dacron is a fabric thread material of a polyester polymer. Mylar and Dacron are trademarks of the Dupont Company. Kevlar is an aramid polymer, and Kevlar is also a trademark of the Dupont Company. Thus the Dacron and Kevlar fabrics and reinforcements made from these materials have the essential function of stabilizing the laminated sail material as the forces are being imposed on the sail fabric or laminate with the fabric or laminate being the load bearing member of the sail.

In a similar manner, the Kevlar and Kevlar laminates (aramid polymers and the derivatives of the aramid family) are being increasingly used because the Kevlar material possesses extremely advantageous strength to weight ratios. Because of the very important weight reduction aloft, the sail construction described in my previous application has achieved substantial savings, e.g., up to about 50% for a mainsail for a 43 foot boat. This has the importance of reducing the pitching and yawing motion and the dynamic loading of a sail.

With less weight aloft, a boat pitches and yaws less, and therefore has a more efficient forward force. However, in the past, reduction of the weight for the sail was likely to increase the risk of distorting the sail.

BRIEF DESCRIPTION OF THE INVENTION

It has further been found, however, that additional reduction in weight and/or cost has been achieved for sails made according to my previously described method; while it has been at a slight sacrifice of strength, this sacrifice is still tolerable, especially when material costs are considered and when appropriate safe wind ranges are observed.

In distinction from my previously described sails, the present sail employs a further novel construction method as well as employs a novel method for distributing the stress in the sail to obtain a novel article of manufacture. This construction method as well as the stress distribution in a sail results in a new structure which has characteristics far superior to the previous sails as known to the inventor, as well as important advantages for the efficiency, economy, weight distribution and dynamic loading behavior in a sail when it is aloft.

Thus the present invention is predicated on the use of a lifting surface, the sail, where the stress is not borne through or by the sail skin, but predominantly by the structural members added on or incorporated in the sail surface. The structural members bear the predominant or major portion of the load; however, in the areas where the sail is stressed the most, these structural members transmit the stresses or loads especially well into the point load locations of the sail, i.e., the corners thereof. Thus, by incorporating in the sail a number of stress bearing members, the skin members function differently from the prior art sails. As mentioned before in my previous application, in the prior art the skin fabric itself is substantially the only stress-bearing member of the sail.

DESCRIPTION OF THE DRAWINGS AND DESCRIPTION OF THE INVENTION HEREIN

With reference to the drawings where the same items are illustrated by the same numbers as in my previous drawings and wherein these show the various embodiments of the present invention:

Figure 1:
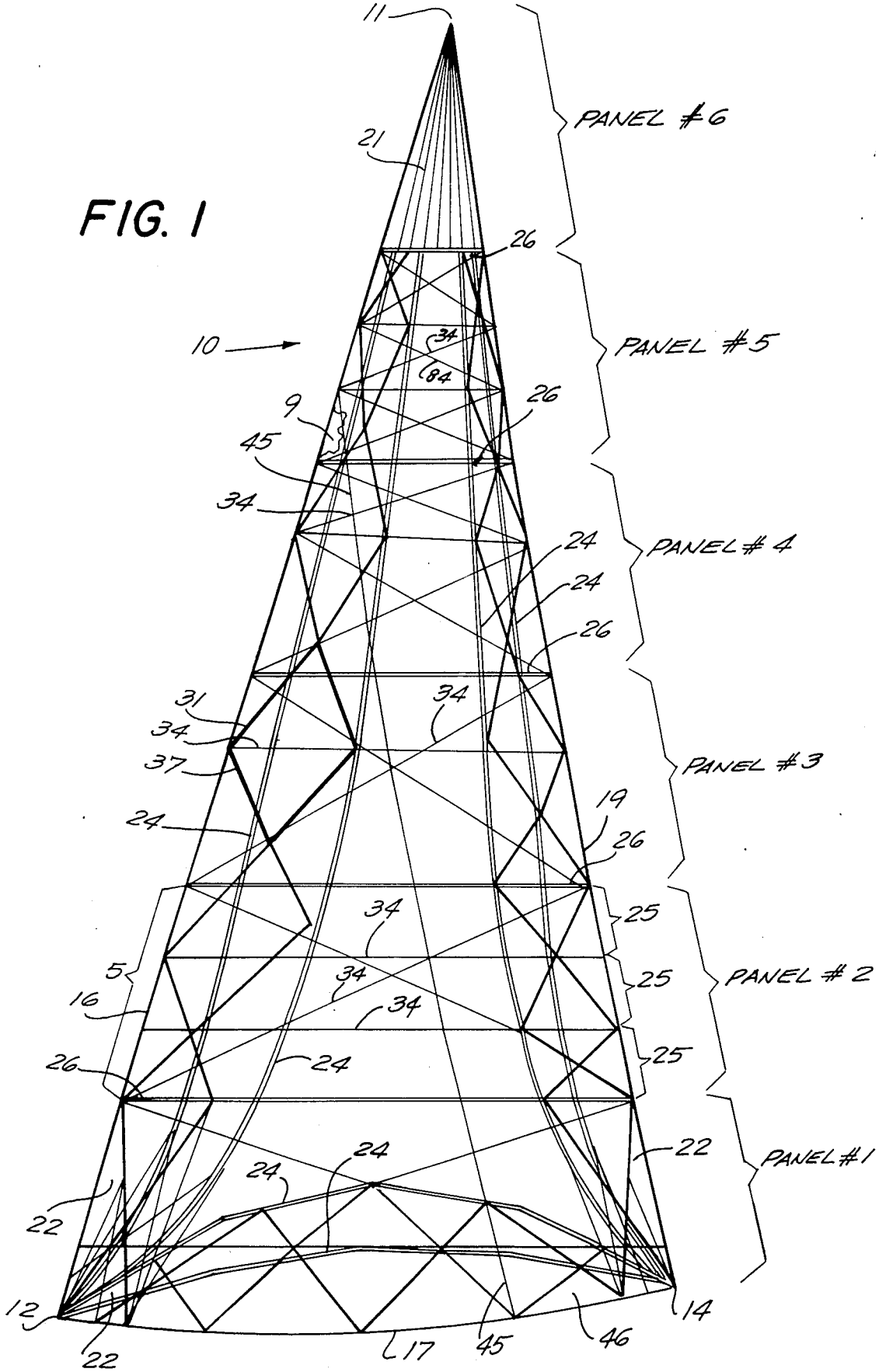
FIG. 1 illustrates in a plan view a typical jib or Genoa sail without its skin members but with structural and grid members according to the presently disclosed improvements.

In accordance with the present invention, the sail 10 shown in FIG. 1 has a skin 9, a head 11, a tack 12, a clew 14, a luff 16, a foot 17 and a leech 19. The sail has head reinforcements shown as 21 which are a number of panels radiating out from the point load at the apex on either one or both sides of the sail.

Similarly, the clew 14 and tack 12 have reinforcement panels 22 of a similar construction.

Thus, in accordance with the present further improvement in FIG. 1, the stress-bearing structural members 24 are in the form of strips or ribbons of Kevlar or Kevlar-Mylar as the preferred material. These structural members may also be of Dacron or nylon depending on the sail. Dacron strips are less advantageous, but present a further possibility. The stress bearing structural members 24 are confined mostly to the high stress bearing areas of the sail. These are shown in FIG. 1 running along the leech 16, luff 19 and the foot 17 of the sail, tending to follow or approximate equal force or load contour lines where the stress is imposed on the sail.

In accordance with this invention, when incorporated as stress-bearing structural members in the sail, these fabric strips may be either a woven fabric or as monofilament yarns (which are glued together in strip form). These may also be Mylar-Kevlar laminate strips. These structural members 24 transmit the point loads into the head 11, tack 12 and clew 14, as well as support the aerodynamic forces imposed on the other construction members of the sail such as skin.

In distinction from my previously described sail, the grid members or grid strip 31 may be reduced greatly in number and made somewhat heavier and made to accomodate in part more of the stress and less of the skin support function previously described for these grid members 31. These are also for the sake of convenience called secondary stress or structural members for the function these serve, but will be designated as grid members 31, or cross grid members 34 or vertical grid members 41.

It was found that the span width, i.e., diamond size 37, may be increased considerably in some parts of the sail if the grid 31, cross grid 34, or vertical grid 41 members are acting as stress bearing members 24. Hence, various different grid arrangements are now employed as further will be described herein. Essentially, however, the grid member density, i.e., latticework pattern density, is greatest in areas of greatest stress, e.g., along the leech 16 of a Genoa sail or mainsail, but other areas of stress are also appropriately designed, e.g., panels #4 and #5 of FIG. 1. For the present embodiments, this added grid member density is typically most dense between or among the employed structural members 24 along an edge of the sail bearing the greatest load and at the top of the sail as shown in FIG. 1.

A sail 10 can further be controlled in an improved manner and has a reduced weight aloft because fewer grid members 31, cross members 34 or vertical members 41 need to be used. Additionally, the structural members 24 cooperate with the larger size grid members 31, 34, or 41. In the overall construction, a lesser number of grid members 31, cross members 34, or vertical members 41 from my previous sail are used. The further weight saving contributes to efficient sail control under various wind conditions by appropriately changing the skin 9 curvature of the sail. The skin 9, of course, on the sail acts almost like a skin on an airplane wing with the stress-bearing structural members 24 and grid members 31, cross grid members 34 or vertical grid members 41, such as in the form of ribbons acting as the support structure for the sail. Consequently, the skin members are not shown but may be indicated substantially as panels 5 or even by a smaller panel 25. These panels 5 or 25 may be constructed in various configurations of panels and may be typically built in the conventional manner and of a variety of panel component layouts. The panels, however, are identified as such and schematically shown and numbered in the drawing, i.e., from #1 to #6.

The novel construction still allows then the skin 9 to be built in a considerably lighter weight and with same or different stress-bearing skin memebers. As the skin member arrangement is not shown in the drawings, any skin member arrangement is possible in conjunction with the novel arrangements of stress bearing members to accomodate the stresses at the light, medium or heavy conditions. Seam 45 shows an added feature, e.g., for the Genoa sail, it defines the forward edge of a Kevlar-Mylar fabric which extends from the leech 19 to seam 45 and is overlaid on the skin 9 of the sail with the structure members, e.g., 24, 26, 31, 34 and 41, either on the opposite side of the sail or on the ply 46 on the outside thereof. This ply 46 helps to give a smooth surface and aids in reducing any lateral discontinuities. As shown in FIG. 1, it is carried into the head panel #6 and all the way into the head. Seam 45 intersects the luff at about 25% of the luff length from the head. The cross grid member 34 density also has been increased toward the head so as to bear better or resist better the heavier aerodynamic loads exerted on the sail 10. The width of the ply 46 may be varied depending on the size of the sail, its purpose, and the maximum safe load for which it has been designed. Typically the denier of the material may be from 200 to 1,000 denier Kevlar or similar material. The denier for the ply is selected on the basis of how much load it needs to bear and how much the structural members 24 and grid members 31, 34 and 41 carry along the leech of the sail. The ply 46 helps in resisting the point loads and the grid members 31 and 34 resist the aerodynamic loads. Therefore the cross grid members 34 advantageously run from luff to leech.

As before described, other advantages for the invention reside such as in the ability to vary the weights of the stress-bearing structural members, e.g., 24, i.e., to have these in various widths, thicknesses or denier weights (for the threads) for the structural members 24, cross structural members 26, and grid members 31, 34, and 41. Typically these members are of laminated Mylar-Kevlar laminates. The Mylar film is from ½ to 3 mills and the Kevlar threads are such as 200, 400, 600 and 1000 denier threads. Appropriate weight is selected for each of the members and for each of the locations on the sail.

As Kevlar in thread form is very strong, fabrics made of these will seldom yield even at the most drastic conditions at which a skin load bearing sail would have long distorted. Corner patches 22 may now be cut to meld into the structural members 24 for the locations where these members are oriented along luff 16, foot 17 and leech 19. Similar construction is now possible for the structural members 24 as these become one of the sections 21 in head panel No. 6.

Moreover, the stress-bearing structural members 24 are oriented in such a manner as to prevent failure mode to propagate through the skin. The skin 9, on the other hand, will not distort in the novel sail as it bears little force and is now properly supported. However, and advantageously, some force or load may be borne by the skin member if it is so desired.

As I had mentioned before, the number and the distribution of the stress-bearing structural members 24 or cross structural members 26 and arrangements thereof may be appropriately incorporated in the sail load bearing structure based on the sail's use and the characteristics therefor, such as for the light, medium, and heavy air conditions. However, because of the design of the stress-bearing structural members 24 in cooperation with members 31, 34 or 41, the sail may have a considerably broader useful operating range as distinguished from the sail where the forces or loads on the sail are carried solely by the fabric itself. Thus the skin members of the sail may also be varied in various weights either for a leech cut sail or a cross cut or typically for the parallel cut members of the sail. Since the skin does not carry much of a load, the skin members may be tailored to suit best the conditions for the particular sail.

In addition, it has been found that the panels may be well supported by structural load bearing members of the cross structural type, i.e., cross structural members 26. Hence, each panel orientation or type thereof in addition may be or have a structural component along the major panel orientations. It is to be noted, however, that in the prior art sails the skin seams or sewed skin panels do not act in the same manner as structural members. Because the seam construction is only for reinforcement purposes of the seams (seams typically fail first), the stress distribution along the seams is not suggested as a construction method unless stress bearing members, such as structural members 24 or members 31, 34 or 41 with cross structural members 26 are used as the stress distribution pattern. Although sails such as leech cut sails try to approximate the stress by panel orientation, the effect is not achieved unless there are incorporated structural members such as 24 and cross structural members such as 26 in the sail to suit the leech cut orientation, and these then are joined with grid members 31, cross grid members 34 or vertical members 41 in the pattern suited for a leech cut sail. Thus all of these must be properly tied together and a thought given to the corner point loads being all tied together, whatever panel orientation is used. These corner point loads are found, e.g., in the head 11, tack 12, and clew 14.

Figure 2:
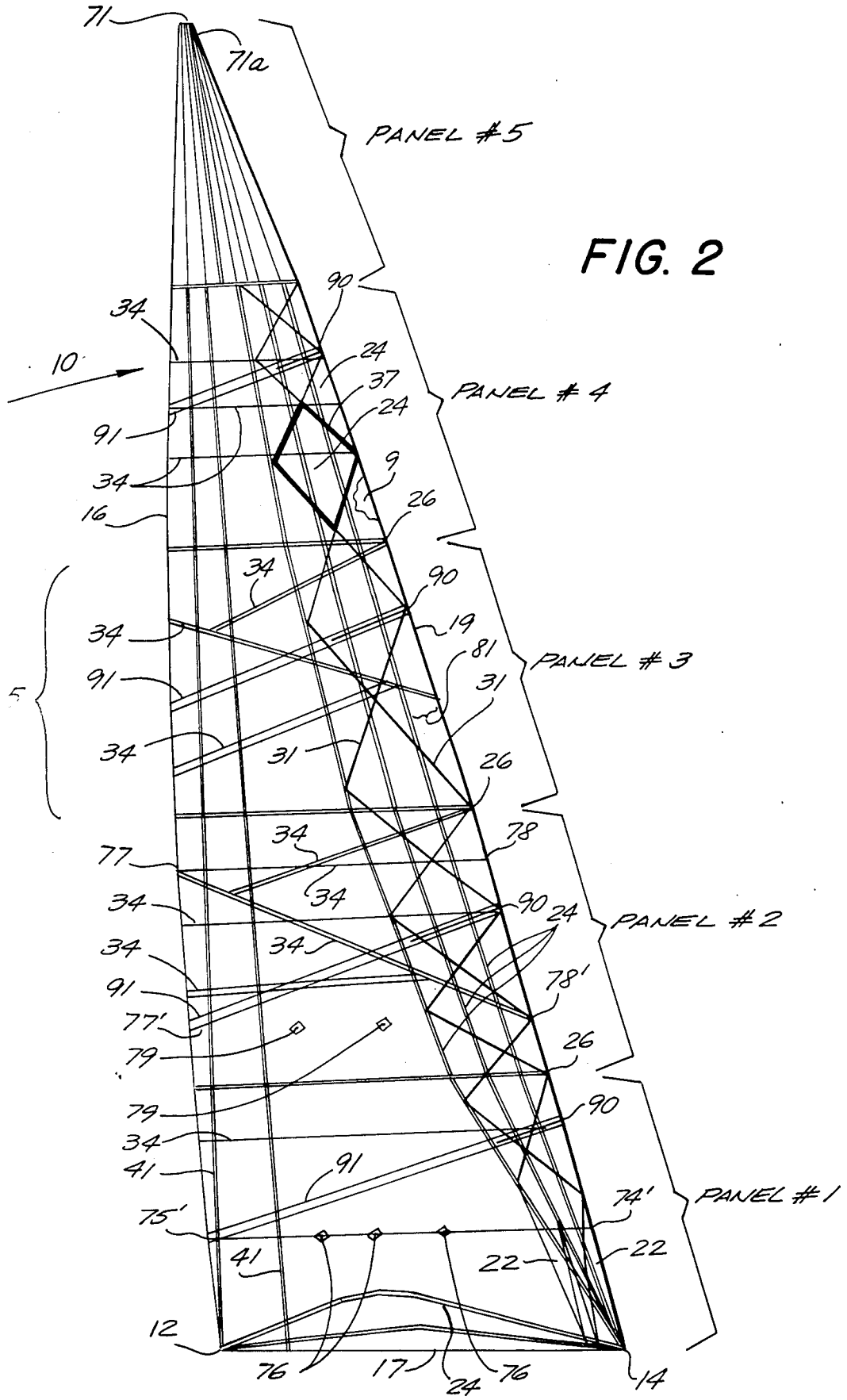
FIG. 2 illustrates in a plan view a typical mainsail embodiment with improvements in the mainsail shown without skin members but with structural and grid members according to the present invention.

The novel construction allows the skin 9 to be used only as the shape defining three-dimensional compound curve body on which the members 24, 26, 31, 34, 41, and corner patches 21 and 22 are placed. Further, the number of cross grid members 34 also form a part of this construction and may be changed and oriented as shown in FIG. 2 and as will be discussed below. Hence, a panel such as panel No. 2, shown in FIG. 2, may be of fewer than three or more than three panels 25 and may be of various and other constructions as long as the stress is being borne by members such as 24, 26, 31, 34, 41, and 21 and 22. These must be properly constructed and oriented, as well as tied together in the proper stress distribution structure for the particular panel format.

It is thus very easy to employ the best characteristics of a skin material, e.g., laminates, without the restrictions imposed by the distortion characteristics of the material.

In addition to the structural members 24 that radiate out of the point load areas such as head 11, tack 12, and clew 14, following or running along approximately the luff 16, foot 17, and leech 19, the cross structural members 26 serve additional purposes. These cross structural members 26 are employed to reinforce the sail 10 and aid the structural members 24, tying these together in a load bearing structure with the further improvement in the network or latticework construction of these with the members 31, 34 and 41.

It has also been found that grid members 31 are advantageously positioned between structural members 24 "tying" these together, such as in a symmetrical or nonsymmetrical pattern forming lattice. Then the "tying" grid members 31, cross grid members 34 or vertical grid members 41, reduced in number but somewhat increased in width, are "tying" the leech and the luff together across each panel or even partially across the panels. This "tying" together with reduced grid members in a symmetrical or nonsymmetrical "free-form" latticework pattern improves the sail. This is accomplished in a manner such as to increase or vary the size, shape or density of the latticework pattern structure supporting the skin member 9 and has resulted in further weight savings.

The novel construction and the sail as described herein provide great variety in the grid members 31 and cross grid members 34 arrangement and have further provided improvements in cost as well as in the performance of the sail.

As mentioned above, these latticework variations may have, but need not have, a geometrical symmetry. These latticework patterns may be constructed in a manner such as to accomodate the stress as best displayed by my previously described sail construction with particular emphasis on the freedom to provide great variations in designing for the stress patterns with grid members 31, cross grid members 34, vertical members 41, stress-bearing structural members 24, and cross structural members 26, now arranged with great freedom. These "free-form" latticework constructions have provided for the unexpectedly greater advantages of designing a sail with enhanced cost and weight saving benefits.

In the same manner as shown in FIG. 1 the mainsail shown in FIG. 2 is being constructed; however, in this instance the structural members follow force contour lines which are typical for a mainsail.

For easier understanding, the secondary structural members have been designated as grid members 31, cross grid members 34 and vertical grid members 41. These will be discussed in conjunction with the manner in which the sail is constructed.

In constructing the novel mainsail, the following steps are employed. The skin of the sail, as shown by item 9 in FIGS. 1 and 2, is constructed as it is conventionally done in the many varieties known in the art.

Typically each panel is shaped by assembling the skin member subcomponents in a panel and then broad seaming each panel to build into the sail the sail shape desired from foot 17 to the head 11. For luff cut Genoas, appropriately shaped panels projecting to the luff 16 from a clew 14 of the sail 10 are used. The skin members are thus cut in panels to introduce the curved, complex shape in the sail 10. Next, on each individual panel 5 appropriate grid marks corresponding to grid members 31, cross grid members 34 or vertical grid members 41 are placed. This appropriate marking of the grid lines on the sail allows then the proper positioning on the sail of members 31, 34 or 41 so as to assure best stress or force-bearing characteristics for each of the particular sails designed for the conditions in which these will be used.

After each of the grid members are affixed to the sail skin 9, such as by gluing or sewing, thereafter the structural members 24, as required, are laid on each panel of the sail over the grid members 31, cross grid members 34 or even vertical members 41 (if appropriate) to be sewn or glued to the sail skin 9 and grid members 31 or cross grid members 34.

Typically cross structural members 26 are sewn or glued on last. Each or some of the structural members 24 or 26 may be attached to the sail by an adhesive. Each panel is constructed separately, and each grid member 31, cross grid member 34 or vertical member 41 or structural member 24 is joined to the next panel, either abuttingly or overlappingly across the cross structural member 26. The cross structural member 26 may be of one or more plies of various widths of Kevlar fabric or laminate.

Thereafter the head 21 and clew and tack patches 22 (which may also be cut to form part of structural member 24 such as by tapering) are laid on each panel separately and the panels joined together.

In constructing the grid pattern, a latticework is created. The latticework consists of a plurality of grid members 31 and cross grid members 31 or vertical members 41, defining on skin 9, a "diamond" 37, shown in FIGS. 1 and 2 with an accentuated line (and, in addition, the latticework is defined by structural members 24 and cross structural members 26). These lattice shapes may be of various forms. Skin panels, i.e., 5, may be of greater and lesser width, and are labeled as such, starting at the foot and ending at the head. In FIGS. 1 and 2, no intermediate panels are used and these are merely indicated as a possibility.

Grid members 31 are shown as straight lines in FIGS. 1 or 2, but may also be of curved lines. These grid members 31 are placed between the structural members 24 and the luff 16, or the structural members 24 and the leech 19 of the sail, or from structural members 24 to the foot 17, but are built for each panel. The cross grid members 34 may be from luff 16 to leech 19 of the sail, or may also be partially across each panel as shown in FIG. 2 for panel No. 2 with partial cross grid members 34 joining cross grid members 34, and either the luff 16 or the leech 19.

Also, along the luff the vertical grid members 41 may be heavier and may need not be as heavy as structural members 24. The placement of grid members 31, cross grid members 34 or vertical members 41 may be one-sided or two-sided on the skin 9, that is, these grid members 31, cross grid members 34 or vertical members 41 may be laid solely on one side of the skin 9 or alternatively on one and then the other side of the skin 9, and these grid members may then be sewn or glued on the sail panel. The grid members 31, cross grid members 34 or vertical grid members 41 are then finished by appropriate seaming or gluing procedures and incorporated in the panel which has previously been cut.

The previously described structural members 24 or 26 may likewise be incorporated in the sail on one side or the other or on the opposite side to grid members 31. Alternatively, the structural members 24 or cross structural members 26 may be laid on the skin panel 5, first on one side, and then the grid members 31 or cross grid members 34 overlaid on the sail on the other side or on the same side and thereby incorporated therein.

The necessary finishing steps are then done such as cringle (not shown), leech line (not shown), or foot line (not shown) placement and incorporation.

As it is shown by the above discussion, the advantages of the present invention consist in the ability to provide a structure and an appropriately constructed skin. The latticework pattern or structure may be made more simple or more complex. Thus the latticework variations provide improved resistance to the aerodynamic loads where needed and also distribute the point loads emanating from the boundaries or corners of the lifting surface.

The sail construction thus provides an improvement basically overcoming two severe stresses heretofore borne solely by the skin. One, it provides the resistance to the aerodynamic load, and also provides a resistance to the boundary load or point load emanating from the boundaries and corners.

In addition, the advantages are realized in that less of the very expensive Kevlar laminate needs to be used such as only for the structural members 24 or 26 and grid members 31, cross grid members 34 and vertical grid members 41. A significant saving is also achieved further by reducing and/or substantially eliminating grid members 41 and by the employment of the grid members 31 or cross grid members 34 in a "free form" or irregular lattice pattern which allow then the load distribution or the force distribution over the sails and between or across the structural members 24 or 26, providing for better shape retention.

Because distortion and shape retention are correlatives of each other, it is clear that a lighter sail can be built for a given range of wind conditions or conversely the range of wind conditions can be extended greatly for the same sail.

Thus some of the grid members 31, cross grid members 34 or vertical grid members 41 may end at a structural member 24 or 26 and need not be formed completely across the sail in an intertied grid latticework as long as the entire latticework pattern or structure is tied together.

In the FIG. 2 sail, the other members of the sail are in addition to those shown for the FIG. 1 sail, e.g., corner patches. Additional corners and their construction are introduced for first reef tack 75' and clew 74', second reef tack 77' and clew 78', and third reef tack 77 and clew 78. Reef points have been shown as 76 and 79 for the first and second reef, respectively.

Moreover, battens 90 are shown, and a typical batten pocket (constructed in a typical manner) and not shown, have been overlaid with a batten structural member 91 of Kevlar material or Mylar-Kevlar on one or both sides of the sail, preferably across the whole width of the sail and from leech 19 across roach 81 to the luff 16 of the sail.

In this manner, the batten structural member 91 becomes a structural member akin to structural member 26, yet serves for a batten pocket reinforcement and performs two functions without requiring an expensive reinforcement for a batten 90, i.e., batten pocket inner end or outer end reinforcement patch or patches (not shown).

This novel technique of construction can be used on any other sail which is being assembled in panels, no matter how these panels are oriented. It is to be noted that most sail assembly is by panels, either what is known as leech-cut panel or a cross-cut panel or any variations thereof. Each of the assemblies employed lends itself to the present method of grid and structural member incorporation, no matter what sail panel construction is being employed.

These forms may take other load bearing grid shapes best suited for each of the panels or for each particular sail. What is important to remember, however, is that if the sail assembly is by panels, that each of the panel construction must join or be integrated with the adjoining panel. As noted previously, each different sail construction technique or panel assembly technique can thereby be improved with the present stress bearing member support system.

Thus the grid members are laid on each of the panels being used in the sail construction in the manner such that an appropriate latticework of the load bearing shapes, e.g., diamonds 37, are formed, but the importance of the present invention is the discovery that great freedom is obtained by using the grid members in any variegated pattern which ties the structural members, e.g., 24 and 26, and join the load points together, e.g., the tack 12, clew 14, and head 11.

Although not shown for either FIGS. 1 or 2, the luff of the sail and the leech of the sail 16 and 19, respectively, may further be enforced by seams such as shown for structural members 24. Of the total sail area, the structural and grid members occupy from about 5% to 20% of the area; about 7% to 12% of the area occupied is more typical and also the preferred area. Although these values have been given as an illustration, lesser strength material (smaller denier) values may be used in wider width. Conversely, for heavier denier material narrower width members may be employed.

This overlapping or joining of the skin panels 5 may be carried out in such a manner that the stress distribution for each of the panels may be appropriately calculated and appropriate width of the structural members 24 and cross structural members 26 may be provided for each of the panels. Thus the grid members 31, cross grid members 34 or vertical grid members 41 may be considerably wider in one part of the sail and considerably narrower in another part of the sail. The width of the grid is also now free from set pattern shapes, although these may be used, but these may now be most conveniently shaped for each of the panels or stress locations, depending on the skin panel 5 location in the sail.

Consequently, the width of these materials, the size of the latticework, and the variegated forms thereof may be appropriately designed to accomodate the various sail sizes and various loads at various locations that are being borne by the sails.

According to the present invention, the skin members which have previously carried the loads on the sail need not participate in the load bearing function of the sail. However, for shaping the sail to have the skin 9 assume the desired compound curvature, about 25% to 40% of the load carried by the sail may be carried by the skin with the rest of the load carried by the novel structure. Again, this is only an approximation for the maximum permissible load, but the percentage of the load on the skin may be varied as the new construction and the novel sail allows great latitude at greatly increased factors of safety and more precise load estimates. Grid members such as 31, 34 and 41, along with the structural members such as 24 or 26, may be designed to participate entirely or predominantly in the load bearing function of the sail. Although the skin may be appropriately designed to carry a portion of the load, e.g., less than about ⅓ of total load, the proportion of the load that the skin bears versus what the grid members, e.g., 31, or the structural members, e.g., 24, bear may be likewise proportioned as best suited in the conditions. In any event, the stress is not distributed in an improved manner, and the stress location and distribution incorporate the advantages from the structural members 24 or cross structural members 26 and the grid members 31, cross grid members 34 or vertical grid members 41 and even the skin 9 in an improved manner.

The aerodynamic load or stress is now distributed over the lifting surface in a netlike fashion throughout the lifting surface by members most capable of bearing the stress imposed on the lifting surface.

Conversely, the sail may be built to accomodate wind ranges heretofore found impossible. The wind ranges, however, are now dictated solely by the boat's heeling moment or sail carrying capacity or the weight of sail desired, rather than the sail's inherent structural load bearing capacity. This allows sail luffing to depower the boat without fear of flogging failure, as the novel sails are believed to be more flogging failure resistant and provide a proper force distribution in the sail.

The spanning of the skin area of the sail by appropriate free-form grid member construction pattern arrangements thus distributes the forces along the structural members and the grid members in an improved manner bearing the loads that the skin bore right into the points or corners of maximum stress concentration.

The span distances are determinative of the load bearing capability of the grid structure as well as the structural members. The forces or loads as these exist in the various parts of the sail may now be tailored independently of or incorporating the skin load to take appropriately the total load. Based on the span distance, the spacing, the height or size of the latticework pattern shapes between the grid members and structural members, the distance between the structural members, the frequency or density of the structural members, the denier size of the structural members, as well as the width of the structural members and the grid members, optimum lifting structure is obtained. The skin 9 is acting on or conforming to the overall lattice structure only as the loading is exerted on it at each condition to assume the overall desired shape for the entire structure. Thus, the novel construction now allows great freedom in the design of a sail.

While the discussion previously has been with respect to the two sails, i.e., the mainsail and/or jib or Genoa sail, various other sails can be likewise constructed. The distribution and the "free-form" grid or lattice patterns provide the freedom in meeting stress loads on each of the panels and in each of the sails in a further improved manner.

With respect to spinnakers and like sails, e.g., drifters, bloopers, staysails, it may not be necessary to use Kevlar as a structural medium, but a more flexible material such as nylon or Dacron.

What is claimed is:

1. As an article of manufacture, a sail, comprising a skin member of a plurality of panels, a plurality of pliant grid members integral with said skin member, said grid members defining a lattice work pattern on said sail, interconnectingly with said panels as load bearing members for said sail; a plurality of pliant structural members integral with said skin member and interconnecting with said panels for load bearing with said skin member and with said grid members, said plurality of structural members interconnectingly joining said panels and projecting interconnectingly into a point-load location for said sail; said grid members also joining interconnectingly said structural members in said sail, and wherein said grid members define a latticework pattern on at least two panels for said sail.

2. The article of manufacture as defined in claim 1 wherein, at least along one edge of said sail, a plurality of structural members and grid members interconnectingly form said latticework pattern.

3. The article of manufacture as defined in claim 2 and wherein said grid members define a latticework pattern on at least two panels of said skin member.

4. The article of manufacture as defined in claim 3 and wherein grid members, cross grid members, and vertical grid members with said structural members define a latticework pattern on said skin member.

5. The article of manufacture as defined in claim 4 and wherein said latticework pattern of grid and structural members is irregular from at least one panel to another panel of said panels forming said skin member.

6. The article as defined in claim 5 and wherein said structural members enter into a point load location on said sail.

7. As an article of manufacture, a sail comprised of at least one continuous skin member of a plurality of panels, including a plurality of corners for said sail, a plurality of pliant grid members integral with said panels, said grid members integrally interconnecting said panels, said grid members defining a latticework pattern on said sail with a plurality of pliant structural members and said latticework interconnectingly adjoining a latticework on an adjacent panel, said latticework pattern interlockingly bearing a load on said sail with said structural members; said plurality of pliant structural members interconnectingly integral with said panels for load bearing with said skin members and with said grid member latticework; said plurality of structural members comprising a plurality of first set of structural members interconnectingly joining said plurality of panels on said sail, and/or a plurality of second set of structural members interconnectingly integral with said first set of structural members and securedly radiating out of at least two boundary point-load locations and into said sail surface.

8. The sail as defined in claim 7, comprised of a continuous skin member of a plurality of panels including a plurality of corners for said sail, a plurality of pliant grid members in strip form integral with said panels, said grid members integrally interconnecting with grid members of at least one adjoining panel, said grid members defining a latticework pattern on said skin member, said latticework interconnectingly adjoining a latticework on an adjacent panel, said grid members in said latticework pattern interlockingly bearing a part of a total load exerted on said sail, said first set of structural members for said sail interconnectingly integral with said panels for said sail, said first set of structural members interconnectingly joining said plurality of panels on said pattern interlockingly bearing a part of a total load exerted on said sail, said second set of structural members for said sail interconnectingly integral with said first set of structural members, and radiatingly and securedly attached to a corner of said sail and tied into said sail, said first and second set of said structural members defining with said grid members said latticework pattern, wherein said latticework pattern is of irregular density and corresponding to a relative stress load distribution on said sail when said sail is in use.

9. The sail as defined in claim 8 wherein said grid members define a latticework pattern between said second set of structural members and with said first set form said latticework pattern along at least one edge of said sail, with a further latticework pattern across at least one panel of said sail.

10. The sail as defined in claim 8 wherein the grid members are in a latticework of an irregular diamond shaped pattern.

11. The sail as defined in claim 8 wherein the grid members are in a latticework of a rectangular pattern among said first and second sets of structural members along at least one edge of said sail with further grid members about transversely to said structural members extending into said panels.

12. The sail as defined in claim 8 wherein the grid members are in a latticework of a variegated shaped pattern between at least two panels.

13. The sail as defined in claim 8 wherein the grid members are in a latticework as means for accomodating a load pattern on said sail along an edge of said sail and between at least two point loads on said sail.

14. The sail as defined in claim 8 wherein the same is a jib sail.

15. The sail as defined in claim 8 wherein the same is a mainsail.

16. The sail as defined in claim 8 wherein the skin member is a fabric or a laminate in a plurality of panels; said grid members are of a Kevlar material and said structural members are of a Kevlar material.

17. The sail as defined in claim 8, wherein said latticework conforms in a span width spacing density to said load bearing severity on said skin member for said sail.

18. The sail as defined in claim 17 wherein said latticework density conforms in density to said load bearing severity of said sail along at least two edges of said sail in accordance with a load bearing severity along each of said edges of said sail.

19. The sail as defined in claim 18 wherein the same is a mainsail.

20. The sail as defined in claim 18 wherein the same is a jib sail.

21. The sail as defined in claim 7, wherein the skin member is continuous and comprises a plurality of panels including a plurality of corners for said sail, a plurality of pliant grid members in strip form across said panels, said grid members integrally interconnecting with grid members of at least one adjoining panel, said grid members defining a latticework pattern on said skin members, said latticework interconnectingly adjoining a latticework on an adjacent panel, said grid members in said latticework pattern interlockingly bearing a part of a load exerted on said sail, and wherein said sail includes a first set of structural members.

22. The sail as defined in claim 7, wherein the skin member is continuous and comprises skin member of a plurality of panels including a plurality of corners for said sail, a plurality of pliant grid members in strip form across said panels, said grid members integrally interconnecting with grid members of at least one adjoining panel, said grid members defining a latticework pattern on said skin members, said latticework interconnectingly adjoining a latticework on an adjacent panel, said grid members in said latticework pattern interlockingly bearing a part of a load exerted on said sail, a plurality of first set of structural members for said sail interconnectingly integral with said panels for said sail, said first set of structural members interconnectingly joining said plurality of panels on said sail, and wherein said sail includes a second set of structural members.

23. The sail as defined in claim 21, wherein the sail has a plurality of panels and wherein the sail has only cross grid members on said skin member.

24. The sail as defined in claim 23, wherein the sail has only cross grid members from one corner of a panel to another corner of a panel.

25. The sail as defined in claim 23, wherein the sail is free of cross grid members and generally parallel to the foot of the sail and running from luff to leech.

26. The sail as defined in claim 23, wherein the sail includes cross grid members short of the leech.

27. The sail as defined in claim 22, wherein the sail has only cross grid members on said skin member.

28. The sail as defined in claim 22, wherein the sail has only cross grid members from one corner of a panel to another corner of a panel.

29. The sail as defined in claim 22, wherein the sail is free of cross grid members and generally parallel to the foot of the sail and running from luff to leech.

30. The sail as defined in claim 22, wherein the sail includes cross grid members short of the leech.

* * * * *